US005367576A

United States Patent [19]

Matsumoto et al.

[11] Patent Number: 5,367,576

[45] Date of Patent: Nov. 22, 1994

[54] HORN SPEAKER

[75] Inventors: Hiroshi Matsumoto; Shin Yamaguchi, both of Kanagawa, Japan

[73] Assignee: Sony Corporation, Tokyo, Japan

[21] Appl. No.: 942,823

[22] Filed: Sep. 10, 1992

[30] Foreign Application Priority Data

Sep. 10, 1991 [JP] Japan ..... 3-258435

[51] Int. Cl.[5] ..... H04R 25/00

[52] U.S. Cl. ..... 381/156; 381/188; 381/205; 181/152

[58] Field of Search ..... 381/156, 205, 188, 88, 381/90, 152, 86; 181/152, 156, 192, 199, 150

[56] References Cited

U.S. PATENT DOCUMENTS

| | | | |
|---|---|---|---|
| 2,102,212 | 12/1937 | Olson | 181/152 |
| 2,541,980 | 2/1951 | Antone | 381/205 |
| 2,853,146 | 4/1958 | Coates | 181/156 |
| 3,136,382 | 6/1964 | Thatler | 381/156 |
| 3,432,002 | 3/1969 | Cohen . | |
| 3,435,910 | 4/1969 | Lahti | 181/152 |
| 3,536,158 | 10/1970 | Blair . | |
| 3,982,607 | 9/1976 | Evans . | |
| 4,082,159 | 4/1978 | Petty | 181/156 |
| 4,225,010 | 9/1980 | Smith . | |
| 4,378,471 | 3/1983 | Shintaku | 381/156 |
| 5,109,423 | 4/1992 | Jacobson et al. | 381/156 |

FOREIGN PATENT DOCUMENTS

| | | | |
|---|---|---|---|
| 0890810 | 9/1953 | Germany | 381/156 |

*Primary Examiner*—Curtis Kuntz
*Assistant Examiner*—Huyen D. Le
*Attorney, Agent, or Firm*—Jay H. Maioli

[57] ABSTRACT

A horn speaker has a cabinet, a speaker body mounted in the cabinet, a horn including at least one horn piece, and threaded attachment bolts. The attachment bolts detachably attach the cabinet, speaker body and horn piece together in such a manner that the horn piece overhangs at least a portion of the speaker body and the cabinet. Each attachment bolt passes through apertures formed in the cabinet, speaker body and horn piece. The construction enables installation of the speaker body from the front of the cabinet and facilitates the assembly process.

11 Claims, 2 Drawing Sheets

HORN SPEAKER

BACKGROUND OF THE INVENTION

1. Field of the Invention

The present invention relates to a horn speaker formed of a speaker body housed in a cabinet and a horn disposed on a front plate of the cabinet and more particularly to a novel and highly effective horn speaker that can be assembled more easily and less expensively than conventional horn speakers.

2. Description of the Prior Art

A conventional horn speaker typically includes a cabinet, a speaker body mounted in the cabinet, and a horn projecting forward from the speaker and cabinet and fixed to a front plate of the cabinet.

In a conventional horn speaker constructed as described above, since the horn is fixed to the front plate of the cabinet and obstructs access to the cabinet from the front, the speaker body has to be inserted into the cabinet from the rear and fixed to the inner face of the front plate of the cabinet. Because of this, there are restrictions as to the shape of the speaker body, the size and shape of the horn, etc.

OBJECTS AND SUMMARY OF THE INVENTION

An object of the present invention is to solve the problems of the prior art described above and in particular to provide a horn speaker wherein the restrictions as to the shape of the speaker body, the size and shape of the horn, etc., are relaxed, so that it is easier to obtain the shapes required for these items by design considerations.

The foregoing and other objects are attained in accordance with the invention by the provision of a horn speaker comprising a cabinet, a speaker body mounted in the cabinet, a horn including at least one horn piece, and attachment means; wherein the attachment means detachably attaches the cabinet, speaker body and horn piece together in such a manner that the horn piece overhangs at least a portion of the speaker body and the cabinet.

In accordance with an independent aspect of the invention, there is provided a horn speaker comprising: a cabinet; a speaker body housed in the cabinet, the cabinet having a front plate formed with an open portion and the speaker body being fixed to the front plate at the open portion; and a horn piece disposed on an outer face of the front plate; the horn speaker being characterized in that the speaker body and the horn piece are integrally fastened to the front plate, at least the horn piece being detachable from the front plate.

In accordance with another independent aspect of the invention, there is provided a method of assembling a horn speaker comprising the steps of: disposing a speaker body within a cabinet; disposing a horn piece to one side of the speaker body so that it overhangs at least a portion of the speaker body and cabinet; and applying detachable fastening means to the cabinet, speaker body and horn piece to fasten the cabinet, speaker body and horn piece detachably together.

A horn speaker constructed in accordance with the invention thus has a cabinet, a speaker body housed in the cabinet and fixed to a front plate of the cabinet at an open portion formed therein, and a horn disposed on the outer face of the front plate of the cabinet. The horn has at least one member or horn piece that is detachable from the front plate of the cabinet, and the speaker body and the horn are integrally fastened to the front plate.

In one embodiment of the invention, the horn has two separate horn pieces, and the two horn pieces are respectively detachably attached to the front plate of the cabinet at locations on opposite sides of the open portion.

In a horn speaker constructed in accordance with the invention, the speaker body is placed into the cabinet from the front of the cabinet rather than from the rear and fixed to the front plate of the cabinet together with the horn. Therefore, restrictions on the design of the speaker body and horn are relaxed.

BRIEF DESCRIPTION OF THE DRAWINGS

A better understanding of the objects, features and advantages of the invention can be gained from a consideration of the following detailed description of the preferred embodiments thereof, wherein a given reference character always refers to the same element or part, and wherein.

DESCRIPTION OF THE PREFERRED EMBODIMENTS

Preferred embodiments of a horn speaker constructed in accordance with the present invention are described below with reference to the accompanying drawings.

Figure 1:
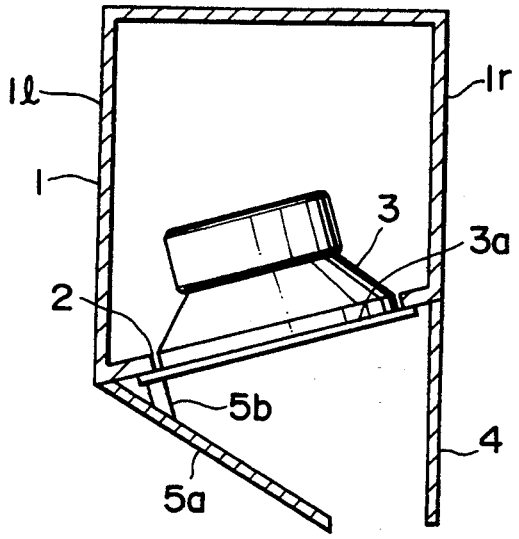
FIG. 1 is a section view taken in a plane parallel to a speaker axis and perpendicular to the planes in which its horn pieces lie, showing a first preferred embodiment of a horn speaker constructed in accordance with the present invention.
Figure 2:
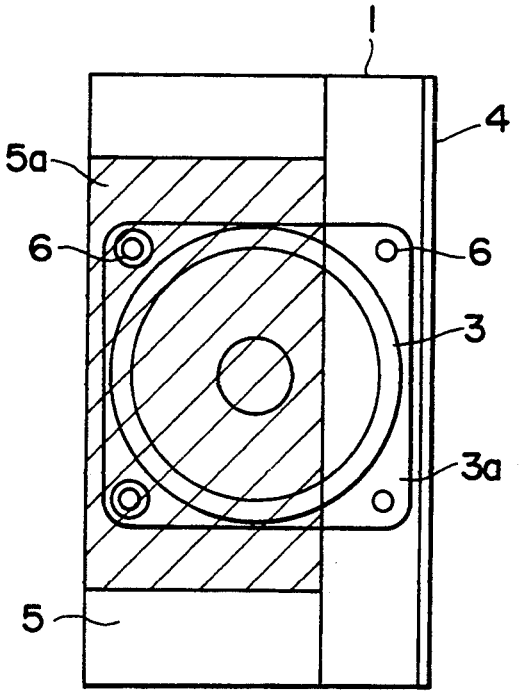
FIG. 2 is a front view of the apparatus of FIG. 1.
Figure 3:
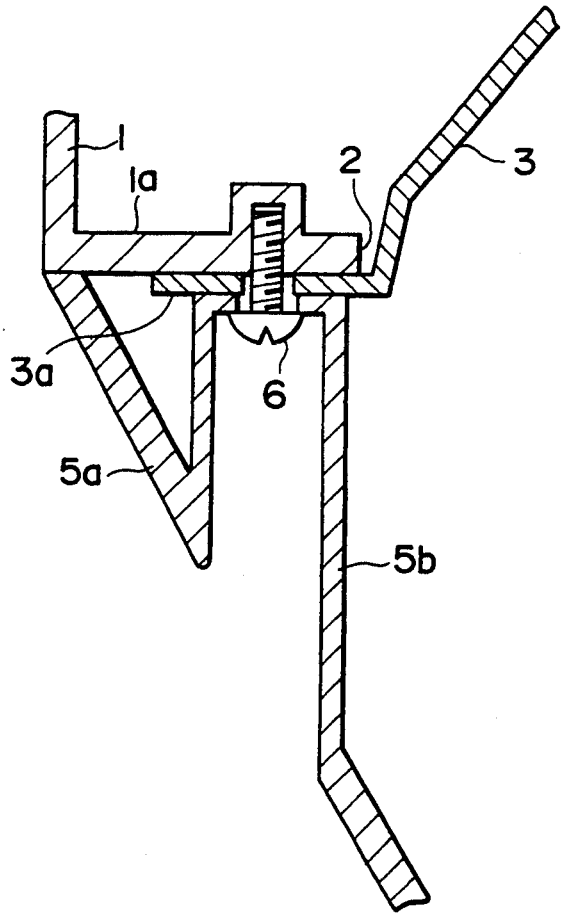
FIG. 3 is an enlarged sectional view of a key portion of the structure shown in FIG. 1.

FIGS. 1 to 3 who a first preferred embodiment of the present invention. FIGS. 1 and 2 show a cabinet 1 in the form of a box. The cabinet 1 can have a variety of shapes, for example, substantially the shape of a rectangular parallelpiped, as illustrated. The cabinet 1 has a front plate 1*a* formed with an open portion 2 having substantially the space of a square. Within the cabinet 1, there is housed a speaker body 3. Projecting forward from the sides 1*l* and 1*r* of the cabinet 1, there are provided respective horn pieces 4 and 5. One horn piece 4 is parallel to (coplanar with) the side wall 1*r*, to which it is permanently or detachably attached by adhesive, sonic welding, a separate screw plate, or in any other suitable way, and the other horn piece 5, which is connected to the sidewall 1*l*, slants so as to partly cover or overhang the front plate 1*a*, opening portion 2, and speaker body 3. The rear of the horn thus has a larger opening than the front. A part 5*a* of the horn piece 5 overhanging the speaker body 3 is arranged to be detachable.

The "covering" or "overhanging" described above does not imply that the horn piece 5 physically touches the speaker cone or that it is suspended or attached at a position above the speaker cone. Rather, as seen from the front of the cabinet 1 or speaker body 3, the horn piece 5 extends from a position on one side of the speaker body 3 (e.g., the left side, the right side, the top side, the bottom side, etc.) to a position in front of the cabinet 1 and speaker body 3; i.e., to a position between the observer on the one hand and the cabinet 1 and speaker body 3 on the other. The dimensions of the horn piece 5 and the dihedral angle formed by the plane of the horn piece 5 and the plane of the front plate 1*a*, etc., are not critical so far as the present invention is concerned and can be selected by the manufacturer in accordance with space and acoustic design considerations. In principle, the horn piece 5 need not even be planar and can be curved in accordance with acoustic and design considerations. The present invention covers not those features but rather the manner in which the cabinet 1, speaker body 3, and horn piece 5 are assembled.

In accordance with the invention, the speaker body 3 is inserted in the interior of the cabinet 1 through the opening portion 2, and four corners of a flange 3*a* at the front of the speaker body 3 are fixed to the cabinet 1 with respective bolts 6. The part 5*a* of the horn 5 is provided with two leg portions 5*b* disposed near its edge that abuts the cabinet 1. One leg portion 5*b* is near the top and the other near the bottom of the part 5*a*, and both leg portions project towards the cabinet 1. Since the leg portions 5*b* are aligned vertically with each other, only one leg portion 5*b* is visible in FIG. 1.

FIG. 3 best illustrates the construction of the leg portions 5*b*. The leg portion 5*b*, the front plate 1*a* of the cabinet 1, and the flange portion 3*a* of the speaker body 3, which is sandwiched between the leg portion 5*b* and the front plate 1*a*, are adapted to be fastened together with a single one of the bolts 6 at each of the two locations where the part 5*a* is attached to the cabinet.

In the embodiment of the invention described above, since the portion 5*a* of the horn 5 overhanging the speaker body 3 is detachable, the speaker body 3 can easily be inserted into the cabinet 1 through the opening portion 2 formed in the front plate 1*a* of the cabinet 1 while the portion 5*a* detached. Thereafter, the flange portion 3*a* of the speaker body 3 and the portion 5*a* of the horn piece 5 can be integrally fastened to the cabinet 1 with the bolts 6. Therefore, restrictions as to the shape of the horn piece 5, the shape, size and method of attachment of the speaker body 3, etc., can be relaxed, and it becomes easier to obtain the shape required by acoustic, mechanical, and aesthetic design considerations. As a result, fabrication becomes easier, productivity is increased, and a better end product results.

Although the case where a portion 5*a* of the horn piece 5 is arranged to be detachable is described above, it is also within the scope of the invention to make the entirety of the horn piece 5 detachable.

Figure 4:
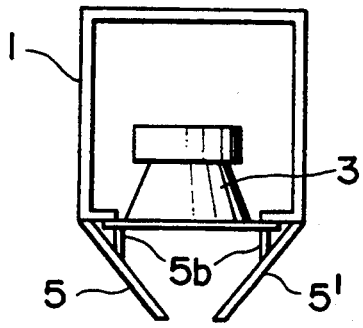
FIG. 4 is a sectional view corresponding to FIG. 1 but showing a second preferred embodiment of a horn speaker constructed in accordance with the present invention.

A pair of horn pieces 5 and 5' may be arranged to slant forwardly and inwardly as shown in FIG. 4, and both of the horn pieces 5 and 5' may be detachable. The horn pieces 5 and 5' in the embodiment of FIG. 4 are preferably mirror images of each other. In the embodiment of the invention illustrated in FIG. 4, the installation of the speaker body 3 in the cabinet 1 becomes still easier.

In accordance with the invention, the two horn pieces may form the same or different angles with respect to the front plate and may form the same or different angles with respect to the sidewalls of the cabinet.

In accordance with the present invention as described above, since at least one horn piece is detachably fixed to the cabinet, restrictions as to the shape of the horn and the shape, size, and method of attachment of the speaker body, etc., can be relaxed. Therefore, the degree of freedom in the designing of the entire assembly becomes greater, the product can be made better, its fabrication becomes easer, and, hence, productivity can be increased.

While the best modes known to the inventor of practicing the invention are disclosed above and illustrated in the drawings, many modifications of it and the other preferred embodiments of the invention will readily occur to those skilled in the art. Accordingly, the preferred embodiments of the invention disclosed above are to be understood as merely exemplary, and the invention is not limited except by the appended claims.

We claim:

1. A horn speaker comprising:

a box-like cabinet having at least side walls and a front plate having an open portion;

a speaker body having a flange and being mounted in the cabinet through the open portion with the flange abutting an exterior surface of the front plate;

a single horn being formed so that a rear portion of the horn has a larger opening than a front portion thereof; and attachment means;

wherein the attachment means detachably attaches the cabinet, the flange of the speaker body and the horn together in such a manner that the horn piece overhangs at least a portion of the speaker body and the front plate of the cabinet.

2. A horn speaker according to claim 1 wherein the flange of the speaker body and the horn are respectively formed with first alignable apertures and the attachment means comprises at least a first threaded member that can be selectively passed through the first apertures for the purpose of securing the speaker body and the horn to the front plate of the cabinet.

3. A horn speaker according to claim 2 wherein the first threaded member comprises a bolt.

4. A horn speaker according to claim 2 wherein the horn is formed with a leg portion extending therefrom, the first alignable apertures being respectively formed in the flange and the leg portion of the horn.

5. A horn speaker according to claim 2 wherein the flange of the speaker body and the horn are respectively formed with second alignable apertures and the attachment means further comprises a second threaded member that can be selectively passed through or withdrawn from the second apertures.

6. A horn speaker according to claim 1 wherein the horn further comprises a first horn piece and a second horn piece which is substantially a mirror image of said first horn piece and the attachment means detachably attaches the cabinet, speaker body and first horn piece together in such a manner that the first horn piece extends in front of the speaker body from one side thereof and detachably attaches the cabinet, speaker body and second horn piece together in such a manner that the second horn piece extends in front of the speaker from a side thereof opposite said one side.

7. A horn speaker comprising:

a box-like cabinet;

a speaker body having a flange at one end and being housed in the cabinet, the cabinet having a front plate formed with an open portion therein and the speaker body being fixed to the front plate at said open portion with the flange abutting an outer face of the front plate; and a single horn piece disposed on the outer face of the front plate and being formed so that a rear portion thereof has a larger opening than a front portion thereof;

said horn speaker being characterized in that the speaker body and the horn are integrally fastened to the front plate with the horn abutting an exterior surface of the front plate of the cabinet, at least the horn being detachable from the front plate.

8. A horn speaker according to claim 7 wherein said horn comprises first and second horn pieces attached to the front plate of the cabinet, and first horn piece and said second horn piece being positioned near opposite edges of the front plate.

9. A horn speaker according to claim 8 wherein the second horn piece is detachably attached to the front plate.

10. A horn speaker according to claim 8 wherein the second horn piece is permanently attached to the front plate.

11. A method of assembling a horn speaker comprising the steps of:

disposing a speaker body within a box-like cabinet having a front plate, with a flange of the speaker body abutting an outer surface of the front plate of the cabinet;

forming a single horn piece so that a rear portion thereof has a larger opening than a front portion thereof;

disposing the horn to one side of the speaker body so that it overhangs at least a portion of the speaker body and the front plate of the cabinet; and applying detachable fastening means to the cabinet, the speaker body and the horn to fasten the cabinet, the speaker body and the horn detachably together.

* * * * *